US007267429B2

(12) United States Patent
Furukawa

(10) Patent No.: US 7,267,429 B2
(45) Date of Patent: Sep. 11, 2007

(54) INK-JET PRINTHEAD SUBSTRATE, DRIVING CONTROL METHOD, INK-JET PRINTHEAD AND INK-JET PRINTING APPARATUS

(75) Inventor: Tatsuo Furukawa, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/555,304

(22) PCT Filed: Jun. 1, 2004

(86) PCT No.: PCT/JP2004/007879

§ 371 (c)(1),
(2), (4) Date: Nov. 2, 2005

(87) PCT Pub. No.: WO2004/110764

PCT Pub. Date: Dec. 23, 2004

(65) Prior Publication Data

US 2006/0209131 A1 Sep. 21, 2006

(30) Foreign Application Priority Data

Jun. 10, 2003 (JP) ..... 2003-165028

(51) Int. Cl.
*B41J 2/05* (2006.01)

(52) U.S. Cl. ..... 347/57; 347/59

(58) Field of Classification Search ..... 347/5, 347/9, 12, 14, 19, 20, 56–59, 61–62
See application file for complete search history.

(56) References Cited

U.S. PATENT DOCUMENTS 5,172,134 A * 12/1992 Kishida et al. ..... 347/57
6,290,334 B1 9/2001 Ishinaga et al. ..... 347/59
6,435,668 B1 8/2002 Barbour et al. ..... 347/60
6,471,324 B1 10/2002 Maru ..... 347/19
6,712,437 B2 3/2004 Furukawa et al. ..... 347/5
6,971,735 B2 12/2005 Saito et al. ..... 347/57
2002/0191037 A1 12/2002 Furukawa et al. ..... 347/5
2006/0125871 A1 6/2006 Furukawa
2006/0139412 A1 6/2006 Sakurai et al.

FOREIGN PATENT DOCUMENTS

EP 1 266 758 12/2002
JP 2001-063054 A 3/2001
JP 2002-370348 A 12/2002

* cited by examiner

*Primary Examiner*—Juanita D. Stephens
(74) *Attorney, Agent, or Firm*—Fitzpatrick, Cella, Harper & Scinto

(57) ABSTRACT

A heater/driver array that includes heaters for generating thermal energy utilized to discharge ink and driver circuits for driving these is mounted on a substrate. The heaters are formed into a plurality of groups and are driven by block drive on a per-group basis. A block selection signal of driving-signal voltage level (VHT) and a heater driving signal corresponding to a selected block are generated based upon a print data signal, which has been input at a logic-signal voltage level (VDD), in any of an input circuit, shift register circuit and decoder circuit. The heater/driver array drives the heaters in accordance with the block selection signal and heater driving signal of the driving-signal voltage level.

17 Claims, 12 Drawing Sheets

INK-JET PRINTHEAD SUBSTRATE, DRIVING CONTROL METHOD, INK-JET PRINTHEAD AND INK-JET PRINTING APPARATUS

TECHNICAL FIELD

This invention relates an ink-jet printhead substrate, an ink-jet printhead and a printing apparatus that uses this printhead. More particularly, the invention relates to an ink-jet printhead in which electrothermal transducers for generating thermal energy necessary to discharge ink and driving circuits for driving the transducers are formed on the same substrate, and to a printing apparatus that uses this printhead.

BACKGROUND ART

In general, an electrothermal transducer (heater) of a printhead mounted on a printing apparatus in accordance with an ink-jet scheme and the driving circuit of the transducer are formed on the same substrate using semiconductor process technology as illustrated in, e.g., U.S. Pat. No. 6,290,334. In a proposed printhead structure, a digital circuit, etc., for sensing the state of the semiconductor substrate, e.g., the substrate temperature, is formed on the same substrate in addition to the driving circuit, an ink supply port is located at the center of the substrate and a heater is disposed at a position opposing the port.

FIG. 5 is a diagram schematically illustrating a semiconductor substrate for an ink-jet printhead of this type, i.e., a semiconductor substrate for an ink-jet printhead that includes a circuit for outputting a digital signal indicative of sensed temperature.

In FIG. 5, reference numeral 500 denotes a substrate obtained by integrally forming heaters and driving circuits by semiconductor process technology, 501 a heater/driver array having a structure in which a plurality of heaters and driver circuits are arrayed, and 502 an ink supply port for supplying ink from the reverse side of the substrate.

Further, reference numeral 503 denotes a shift register for temporarily holding print data to be printed. Reference numeral 507 denotes a decoder circuit that outputs a heater-block selection signal for driving the heaters in the heater/driver array 501 on a per-heater-block basis. Reference numeral 504 denotes an input circuit that includes a buffer circuit for inputting a digital signal to the shift register 503 and decoder 507. Reference numeral 510 denotes an input terminal that includes a terminal for supplying logic-element voltage VDD, a terminal CLK for inputting a clock and a terminal for inputting print data, etc.

FIG. 7 is a timing chart for describing a series of operations up to sending of print information to the shift register 503 and supplying of current to heaters to drive the same.

Print data is supplied to DATA_A and DATA_B terminals in sync with a clock pulse applied to the CLK terminal. The shift register 503 stores the supplied print data temporarily and a latch circuit latches the print data in response to a latch signal applied to a BG terminal. A block signal, which is for selecting a group of heaters that have been partitioned into a desired block, and the print data that has been latched by the latch signal are subsequently subjected to an AND operation in matrix form, and the heater current flows in sync with an HE signal that directly decides current drive time. This series of operations is repeated block by block to perform printing.

FIG. 6A is one segment's worth of an equivalent circuit for driving current into a heater for discharging ink. Further, FIG. 6B is an equivalent circuit that corresponds to one bit of a shift register and latch circuit for temporarily storing image data to be printed.

A block select signal that is input to an AND gate 601 is a signal sent from the decoder 507 for selecting heater groups partitioned into blocks. Further, a bit signal that enters the AND gate 601 is a signal transferred to the shift register 503 and thenceforth latched by a latch signal. In order to turn on each segment selectively by print data, the AND gate 601 obtains the AND, in matrix form, between the block select signal and bit signal.

Reference numeral 605 denotes a VH power-supply line that serves as a power supply for heater drive, 606 a heater and 607 a driver transistor for passing current into the heater 606. Reference numeral 602 denotes an inverter circuit for receiving and buffering the output of the AND gate 601. Reference numeral 603 denotes a VDD power-supply line that serves as a power supply for the inverter circuit 602. Reference numeral 608 denotes an inverter circuit serving as a buffer for receiving the buffered output of the inverter circuit 602. Reference numeral 604 denotes a VHT power-supply line serving as a power supply, which is supplied to a buffer 608, for supplying the gate voltage of the driver transistor.

In general, the inverter 602 and shift register 503, etc., are digital circuits and they basically operate in accordance with low/high pulses. Further, applied pulses for interfacing print information of the printhead per se and for driving the heaters also are digital signals, and an exchange of signals with the outside is performed in its entirety by low/high logic pulses. Generally the amplitudes of these logic pulses are 0V/5V or 0V/3.3V, and the power supply VDD of the digital circuits is supplied with a signal one of these voltages. Accordingly, pulses having the amplitude of the VDD voltage are input to the AND gate 601 and are input to the inverter circuit 608 of the next stage through a buffer constituted by the two-stage inverter circuit 602.

On the other hand, the smaller the resistance value of the driver transistor 607 when the latter is in the ON state, or the so-called ON resistance, the better. By making power consumed by components other than the heaters as small as possible, a rise in substrate temperature can be prevented and it is possible to drive the printhead stably. If the ON resistance of the driver transistor 607 is large, a voltage drop ascribable to heater current that flows through this portion increases and it becomes necessary to apply an excessively high voltage to the heaters. The result is wasteful power consumption.

In order to reduce the ON voltage of the driver transistor 607, the voltage applied to the gate of this transistor is required to be set high. In the circuit illustrated in FIG. 6A, therefore, it becomes necessary to provide a circuit for making a conversion to pulses having a voltage amplitude higher than the voltage VDD. In the circuit shown in FIG. 6A, the power-supply line 604 of voltage VHT higher than voltage VDD is provided and a segment selection signal that has entered in response to the pulse having the amplitude of the voltage VDD is converted to a pulse having the amplitude of voltage VHT by a buffer circuit that includes the inverter circuit 608. After the conversion is thus made to the pulse having the amplitude of voltage VHT, the pulse is applied to the gate of the driver transistor 607. In other words, an arrangement is adopted in which the exchange of signals with the outside and signal processing by the internal digital circuit are performed in their entirety by pulses having the voltage amplitude (voltage for driving the logic circuits) of VDD, and each segment is provided with a circuit (pulse-amplitude converting circuit) for effecting a conversion to pulses of the VHT voltage amplitude (the voltage for element drive) immediately before the gate of driver transistor 607 is driven.

In general, a printhead-takes on a form in which a plurality of individual segments are arrayed at a high density, and therefore in a case where the segments are arrayed at a density of, e.g., 600 dpi, segment width in the array direction is limited to about 42.3 μm. If it is attempted to fit the entirety of the circuit of the kind shown in FIG. 6A in this pitch for driving each of the elements, then the length of each segment will increase in a direction perpendicular to the array direction.

FIG. 10 is a circuit diagram of an equivalent circuit in a case where the pulse-amplitude converting circuit in FIG. 6A is shown in detail. It will be understood from observing this diagram that the pulse-amplitude converting circuit, particularly a level converter indicated by the dashed lines, is composed of a number of transistors, and therefore a greater chip area becomes necessary.

However, when the layout structure of the printhead substrate having the above-described construction is considered, the pulse-amplitude converting circuit provided for each segment leads to an increase in the length of each segment, invites an increase in chip size and raises cost. More specifically, with the above-described layout, the chip becomes larger in a direction perpendicular to the segment array and the increase in chip size becomes pronounced. Further, in a case where the pulse-amplitude converting circuit is provided for every segment, e.g., in a case where consideration is given to a printhead having, e.g., 256 segments, the number of buffer circuits required necessitates at least 256 inverters. This invites a decline in yield and in a more complicated circuit structure and is a cause of higher cost.

DISCLOSURE OF INVENTION

The present invention has been devised in view of the foregoing problems and its object is to provide a circuit arrangement in which a voltage for driving logic is converted to a voltage for driving elements without increasing the length of segments in a direction perpendicular to the array direction of the segments.

Another object of the present invention is to reduce pulse-amplitude converting circuits and reduce the number of elements formed on the substrate, thereby raising yield and simplifying circuit structure.

A substrate for an ink-jet printhead according to the present invention for the purpose of attaining the foregoing objects has the structure described below.

That is, according to the present invention, there is provided an ink-jet printhead substrate on which are mounted electrothermal transducers for generating thermal energy utilized to discharge ink and driver circuits for driving the electrothermal transducers, comprising: a logic circuit for outputting a block selection signal and an element driving signal, which is for each electrothermal transducer in a selected block, at a second voltage amplitude level based upon an input signal of a first voltage amplitude level; and a driver circuit for driving the electrothermal transducers in block units based upon the block selection signal and element driving signal from the logic circuit.

Further, in accordance with the present invention that attains the foregoing objects, there is provided a drive method suited to a substrate for an ink-jet printhead.

That is, according to one aspect of the present invention, there is provided a method of controlling drive of electrothermal transducers on a substrate on which are mounted electrothermal transducers for generating thermal energy utilized to discharge ink and driver circuits for driving the electrothermal transducers, comprising: inputting an input signal of a first voltage amplitude level; outputting a block selection signal and an element driving signal, which is for each electrothermal transducer in a selected block, at a second voltage amplitude level based upon the signal that has been input; and driving the electrothermal transducers in block units based upon the block selection signal and element driving signal from the logic circuit.

Further, in accordance with the present invention, there is provided an ink-jet printhead that uses the above-described substrate for an ink-jet printhead, and an ink-jet printing apparatus that uses this ink-jet printhead.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will now be described in detail with the accompanying drawings.

The term "print" used in the present invention signifies not only imparting an image having the meaning of text or graphics to a printing medium but also imparting an image that does not have the meaning of a pattern or the like.

The term "substrate" used below not only refers to a simple substrate comprising a silicon semiconductor but also to a substrate that has been provided with various elements, circuits and wiring.

It should be noted that the substrate made have the shape of a board or chip.

The expression "on the substrate" not only refers simply to the top of the substrate but also to the surface of the substrate and the interior of the substrate in the vicinity of the surface. Further, "built-in" used in the present invention refers not only to the simple placing of separate elements on the substrate but also to the formation and manufacture of elements on the substrate as an integral part thereof by a semiconductor-circuit manufacturing process or the like.

With the substrate for an ink-jet printhead of the embodiment described below, voltage conversion of pulse amplitude that was performed immediately prior to input to the gate terminal of the driver transistor 607 is carried out before taking the AND between decoder output (Block Select) and shift-register output (BIT) on a per-segment basis. Further, a voltage higher than the logic voltage is applied to the part of the circuit that takes the AND on a per-segment basis. In the present embodiments, therefore, the element of this portion is made a transistor of a higher withstand voltage than that of the other logic circuits, namely decoders and shift registers (S/R). By virtue of this arrangement, a segment selection signal that has been input in response to a pulse having the amplitude of a VDD voltage can be converted to a pulse having the amplitude of VHT voltage without increasing the length of each segment in a direction perpendicular to the array direction of the segments. In particular, with the arrangement of the present embodiments, conversion of pulse width is performed before the AND is taken between the output signal from the decoder side and the signal from the side of the shift register, and therefore a pulse-amplitude converting circuit provided for every segment is no longer necessary. The number of pulse-amplitude converting circuits themselves can be reduced to the sum of the number of time-division drive blocks (the number of signal outputs from the decoder) and the number of data items corresponding to each block (the number of outputs from the shift register), yield is raised and the circuit arrangement is simplified.

"First Embodiment>

First, an overview of an ink-jet printing apparatus will be described

Figure 8:
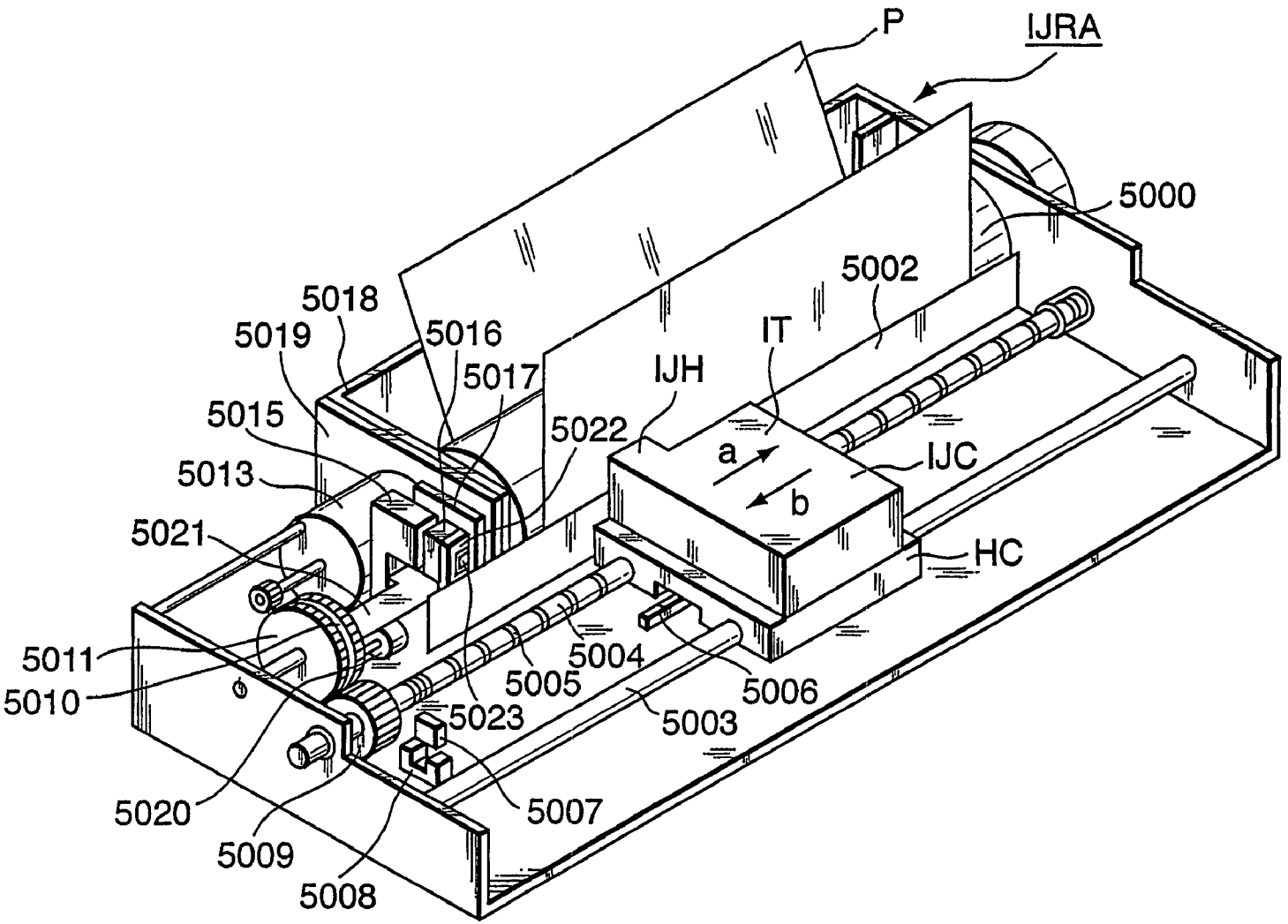
FIG. 8 is an external view of an ink-jet printing apparatus to which the present invention is applicable.

FIG. 8 is an external view of an ink-jet printing apparatus to which the present invention is applicable. In FIG. 8, a lead screw 5005 rotates via driving force transmission gears 5011, 5009 in operative association with the forward and reverse rotation of a driver motor 5013. A carriage HC has a pin (not shown) that mates with a helical groove 5005 of the lead screw 5004 and that is moved back and forth in directions of arrows a and b as the lead screw 5004 rotates. An ink-jet cartridge IJC is mounted on the carriage HC.

Reference numeral 5002 denotes a paper retaining plate which presses paper against a platen 5000 along the traveling direction of the carriage. Reference numerals 5007, 5008 denote photosensors which constitute home position sensing means for verifying the presence of a carriage lever 5006 in the vicinity of the photosensors and changing over the direction in which the motor 5013 is rotated. Reference numeral 5016 denotes a member which supports a cap member 5022, which is for capping the front side of the printhead. Reference numeral 5015 denotes suction means for applying suction to the cap. The suction means subjects the cap to suction recovery via an opening 5023 inside the cap. Reference numeral denotes a cleaning blade, and reference numeral 5019 denotes a member which makes it possible to move the blade back and forth. These are supported on a support plate 5018 of the main body. It goes without saying that the blade need not be of this form and that a well-known cleaning blade can be applied to this example. Reference numeral 5021 denotes a lever for starting the suction of the suction recovery operation. The lever moves with movement of a cam 5020 engaged with the carriage. Movement is controlled by well-known transmission means whereby the driving force from the driver motor is changed over as by a clutch.

It is so arranged that the capping, cleaning and suction recovery are carried out by desired processing at the corresponding positions by operation of the lead screw 5004 when the carriage has arrived in the area on the home-position side. However, if it so arranged that a desired operation is carried out at a well-known timing any is applicable to this example.

Figure 9:
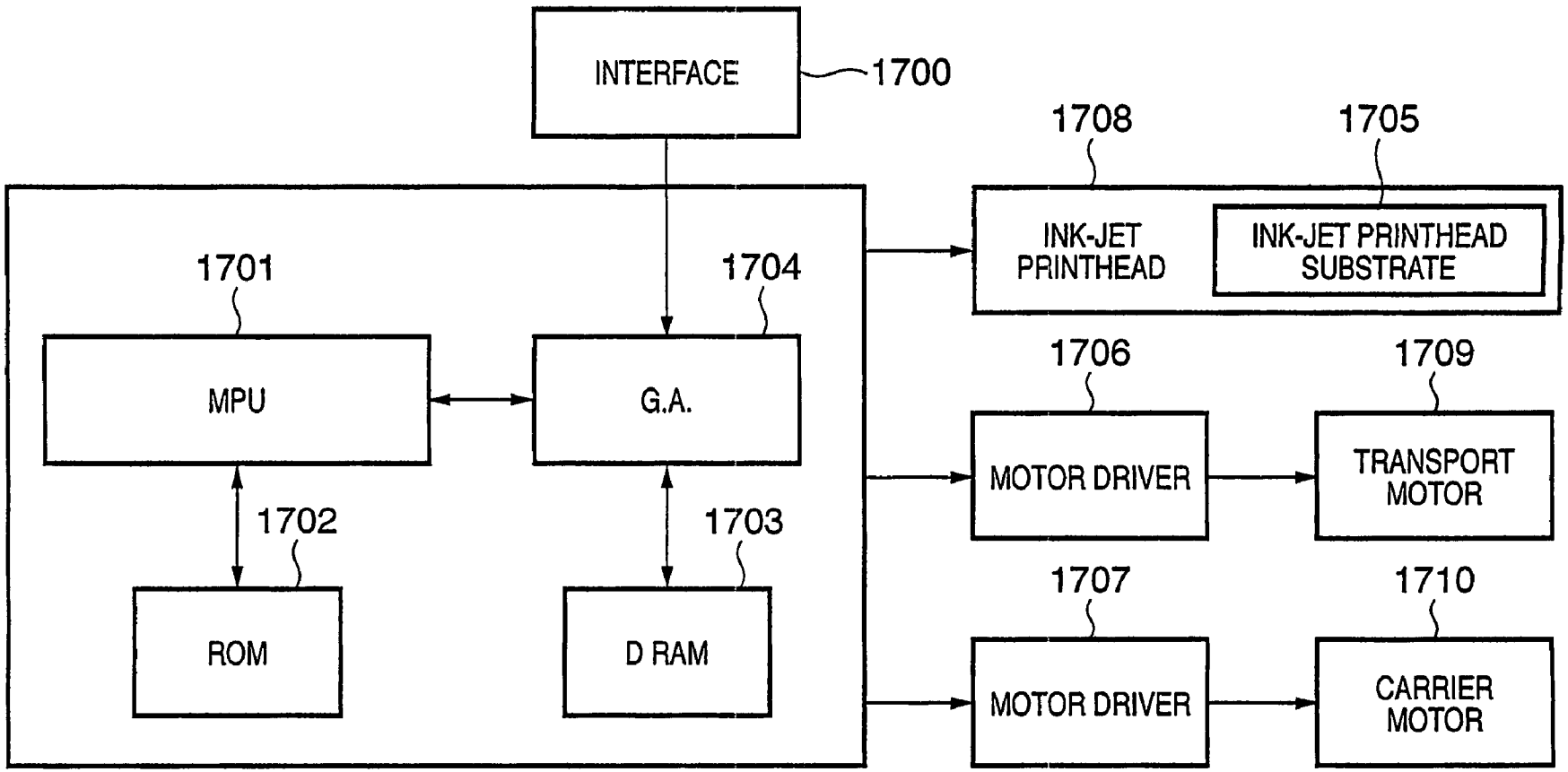
FIG. 9 is a diagram illustrating a control arrangement for executing control of printing by the ink-jet printing apparatus shown in FIG. 8.
Figure 10:
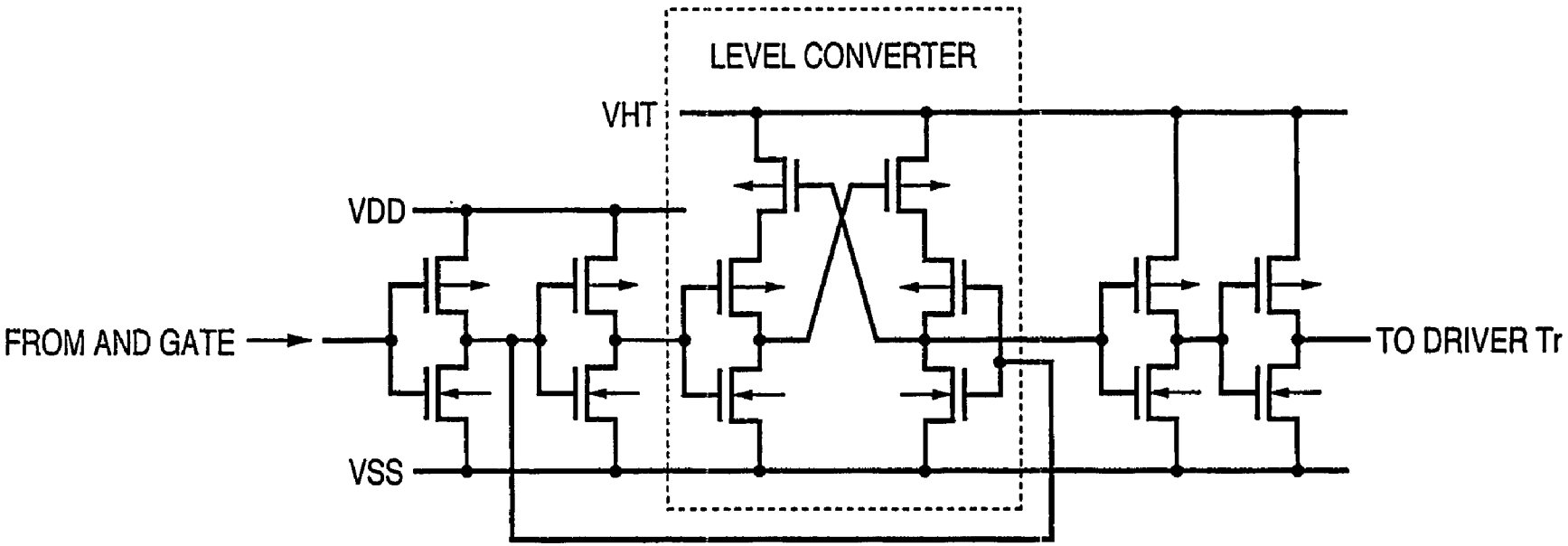
FIG. 10 is a diagram illustrating an equivalent circuit of a pulse-amplitude converting circuit.

Reference will now be had to the block diagram of FIG. 9 to described a control arrangement for executing printing control of the above-described ink-jet printing apparatus. In this diagram illustrating a control circuit, reference numeral 1700 denotes an interface, 1701 an MPU, 1702 a program ROM for storing a control program executed by the MPU 1701, and 1703 a dynamic-type RAM (DRAM below) for storing various data (such as the above-mentioned print signal as well as print data supplied to the head) in advance. Reference numeral 1704 denotes a gate array for controlling supply of print data to the printhead 1708. A signal for driving the printhead is supplied via this gate array. Further, the gate array controls transfer of data between the interface 1700, MPU 1701 and RAM 1703.

Reference 1710 denotes a carrier motor for transporting the printhead 1708, and 1709 a transport motor 1709 for transporting printing paper. Reference numeral 1704 denotes an ink-jet printhead substrate mounted on the printhead 1708 and including an ink-discharge heater and its drive circuit. Reference numerals 1706, 1707 denote motor drivers for driving the transport motor 1709 and carrier motor 1710, respectively.

Operation of the above-described control arrangement will now be described. When a print signal enters the interface 1700, the print signal is converted to print data for printing between the gate array 1704 and MPU 1701. The motor drivers 1706, 1707 are driven and the ink discharge heaters are driven to perform printing in accordance with the print data sent to the printhead substrate within the printhead 1708.

Figure 11:
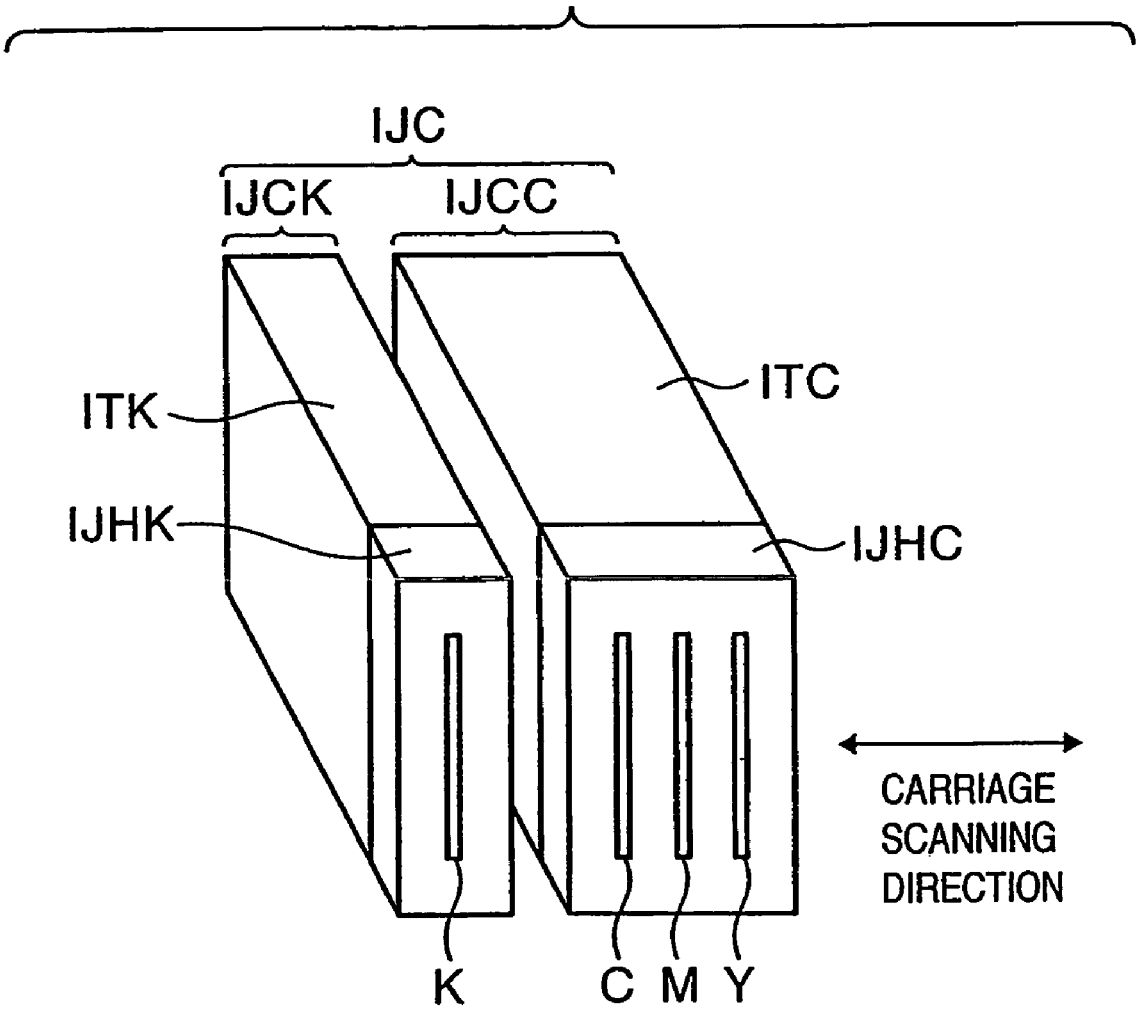
FIG. 11 is a perspective view showing a detailed outer appearance of an inkjet cartridge IJC.

FIG. 11 is a perspective view showing a detailed outer appearance of the configuration of an inkjet cartridge IJC.

As shown in FIG. 11, the inkjet cartridge IJC is comprised of a cartridge IJCK that discharges black ink and a cartridge IJCC that discharges three colors of ink, cyan (C), magenta (M) and yellow (Y). These two cartridges are mutually separable, with each being independently detachably mounted on the carriage HC.

The cartridge IJCK is comprised of an ink tank ITK that contains black ink and a printhead IJHK that prints by discharging black ink, combined in an integrated structure. Similarly, the cartridge IJCC is comprised of an ink tank ITC that contains ink of three colors, cyan (C), magenta (M) and yellow (Y), and a printhead IJHC that prints by discharging ink of these colors, combined in an integrated structure.

Further, as can be appreciated from FIG. 11, an array of nozzles that discharges black ink, an array of nozzles that discharges cyan ink, an array of nozzles that discharges magenta ink and an array of nozzles that discharges yellow ink are aligned in a direction of movement of the carriage, the arrayed direction of the nozzles being disposed perpendicular to the carriage movement direction.

Figure 12:
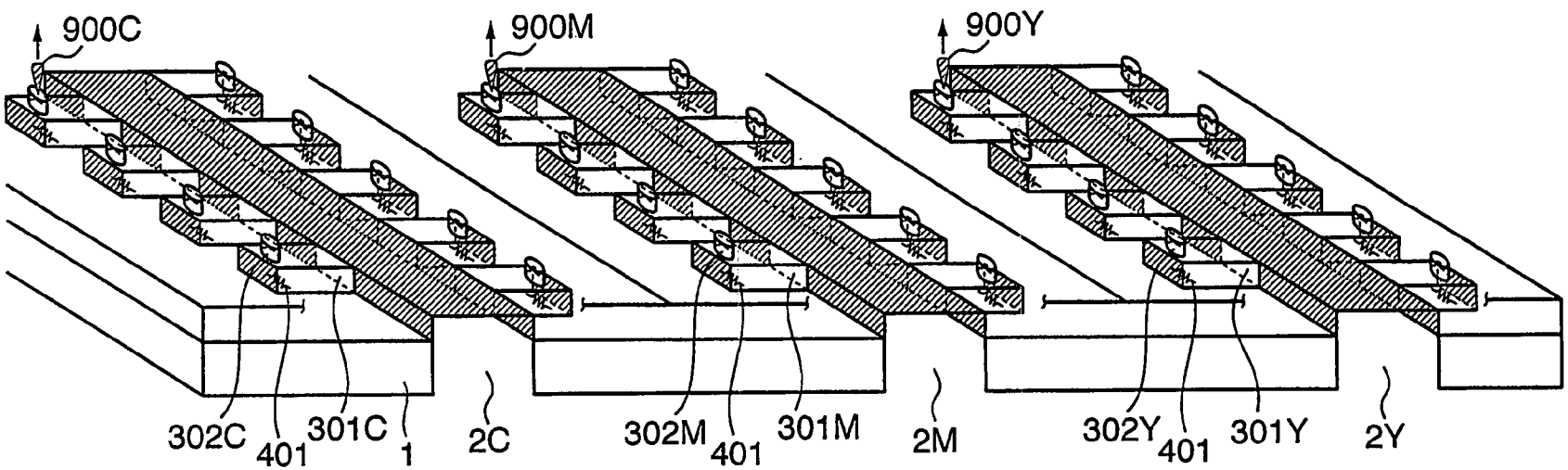
FIG. 12 is a perspective view showing a three-dimensional structure of a printhead IJHC that discharges three colors of ink.

FIG. 12 is a perspective view showing a three-dimensional structure of a printhead IJHC that discharges three colors of ink.

FIG. 12 shows the flow of ink supplied from the ink tank ITK. The printhead IJHC has an ink channel 2C that supplies cyan (C) ink, an ink channel 2M that supplies magenta (M) ink, and an ink channel 2Y that supplies yellow (Y) ink, and is provided with supply paths (not shown), that supply each of the inks via a rear surface of the substrate from the ink tank ITK to each of the ink channels.

The cyan, magenta and yellow inks that pass through the ink channels ink flow paths 301C, 301M and 301Y, respectively, are each led to electrothermal transducers (that is, heaters) 401 provided on the substrate. Then, when the electrothermal transducers (heaters) 401 are activated via circuits to be described later, the ink on the electrothermal transducers (heaters) 401 is heated, the ink boils, and, as a result, ink droplets 900C, 900M and 900Y are discharged from the orifices 302C, 302M and 302Y by the bubble that arises.

It should be noted that, in FIG. 12, reference numeral 1 denotes a printhead substrate (hereinafter referred to as "substrates") on which are formed electrothermal transducers and the variety of circuits that drive the electrothermal transducers to be described later, a memory, a variety of pads that form the electrical contacts with the carriage HC, and a variety of signal wires.

Moreover, one electrothermal transducer (heater), the MOS-FET that drives it and the electrothermal transducer (heater) are together called-a printing element, with a plurality of printing elements called a printing element.

Note that although FIG. 12 is a diagram showing a three-dimensional structure of a printhead IJHC that discharges three colors of ink, the structure is the same as that of the printhead IJHK that discharges black ink but comprising one third of the configuration shown in FIG. 12. In other words, there is one ink channel, and the scale of the printhead is approximately one third that of the structure shown in FIG. 12.

Figure 1:
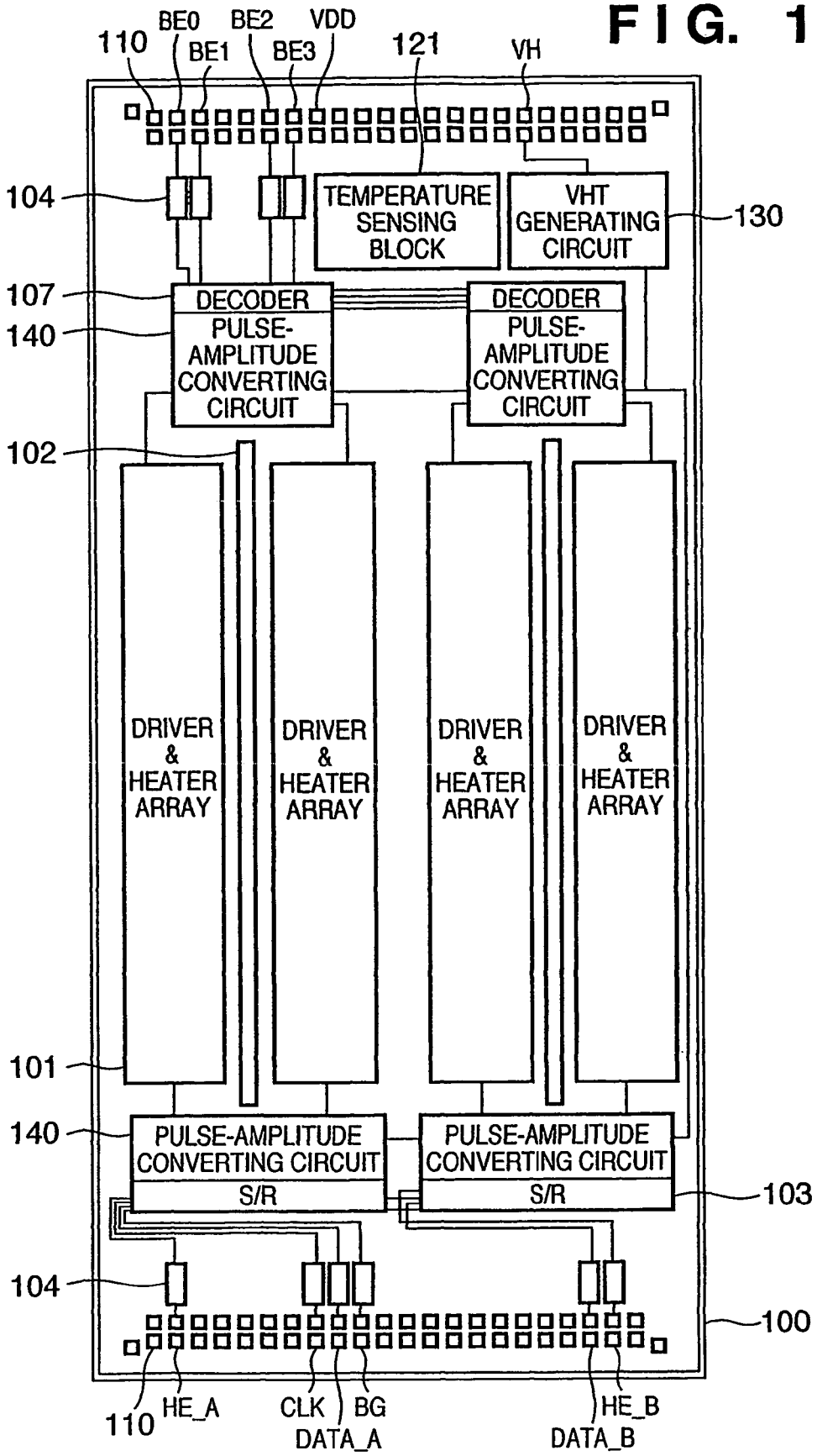
FIG. 1 is a diagram useful in describing the structure of an ink-jet printhead according to a first embodiment.

FIG. 1 is a diagram for describing the structure of the ink-jet printhead according to the first embodiment. Reference numeral 100 denotes a substrate in which heaters and driving circuits have been built in by a semiconductor process technology. This substrate corresponds to the above-described substrate 1705 for an ink-jet printhead. Reference 102 denotes an ink supply port (that is, the supply path) for supplying ink from the reverse side of the substrate, 101 a heater/driver array in which a plurality of heaters and driver circuits are arrayed, wherein the heaters are electrothermal transducers for discharging ink and the drivers are for selectively driving the heaters. Reference numeral 103 denotes a shift register, which possesses data corresponding to one block of time-division drive, for temporarily holding print data to be printed, 107 a decoder circuit for selecting and driving the heaters in the heater/driver array on a per-heater-block basis, 104 an input circuit that includes a buffer circuit for inputting a digital signal to the shift register 103 and decoder 107, and 110 an input terminal.

Further, reference numeral 130 denotes a VHT voltage generating circuit for generating a VHT voltage, which is supplied to a pulse-amplitude converting circuit, based upon a heater-driving power-supply voltage (VH), and 140 a pulse-amplitude converting circuit for converting a digital signal having a VDD voltage amplitude to a gate driving pulse of a driver transistor having the VHT voltage amplitude. As will be understood from FIG. 1, the pulse-amplitude converting circuit 140 of this embodiment is provided in an output stage of the decoder circuit 107 and in the output stage of the shift register 103.

Reference numeral 121 denotes a temperature sensing block constructed to include an element for sensing the temperature of the semiconductor substrate 100. Though the temperature sensing block 121 for sensing the temperature of the substrate is exemplified as an element for monitoring the state of the substrate, it may be equipped with an element for sensing the resistance value of an electrothermal transducer or an element for sensing the resistance value of the current driving transistor at the time of operation thereof. It goes without saying that sensing elements of a plurality of types may be provided.

Figure 2:
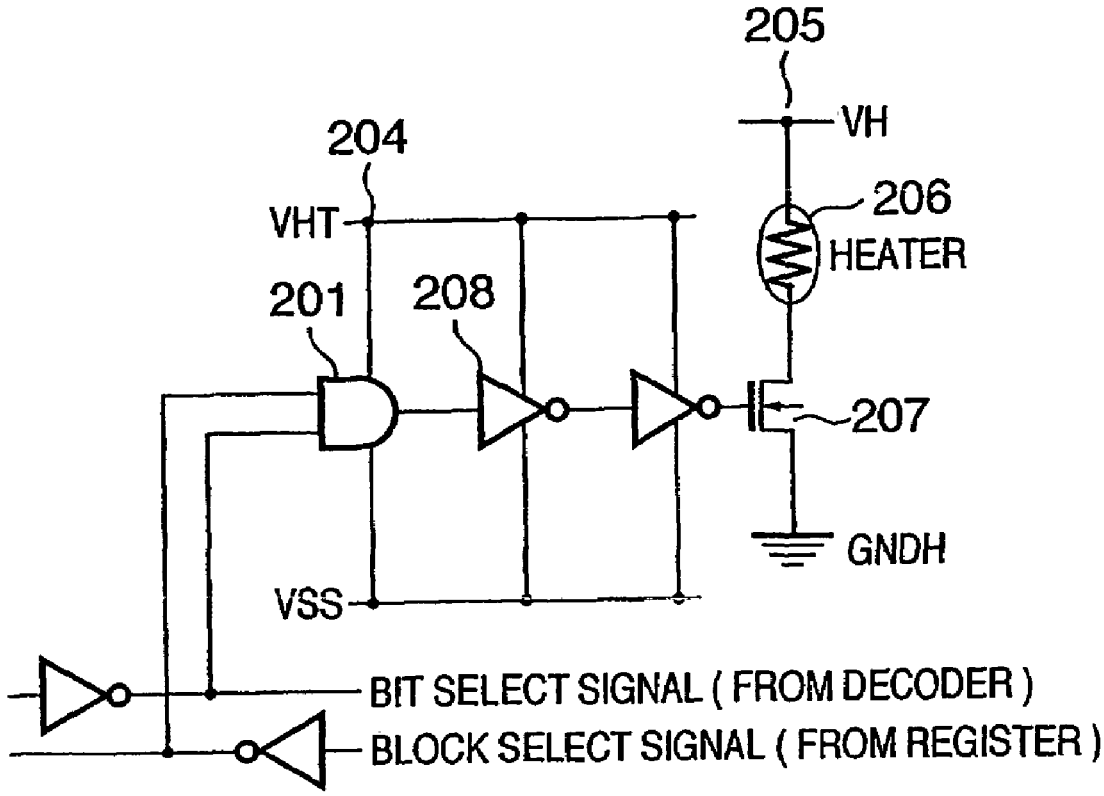
FIG. 2 is one segment's worth of an equivalent circuit diagram for supplying current to and driving a heater for discharging ink in the first embodiment.
Figure 3:
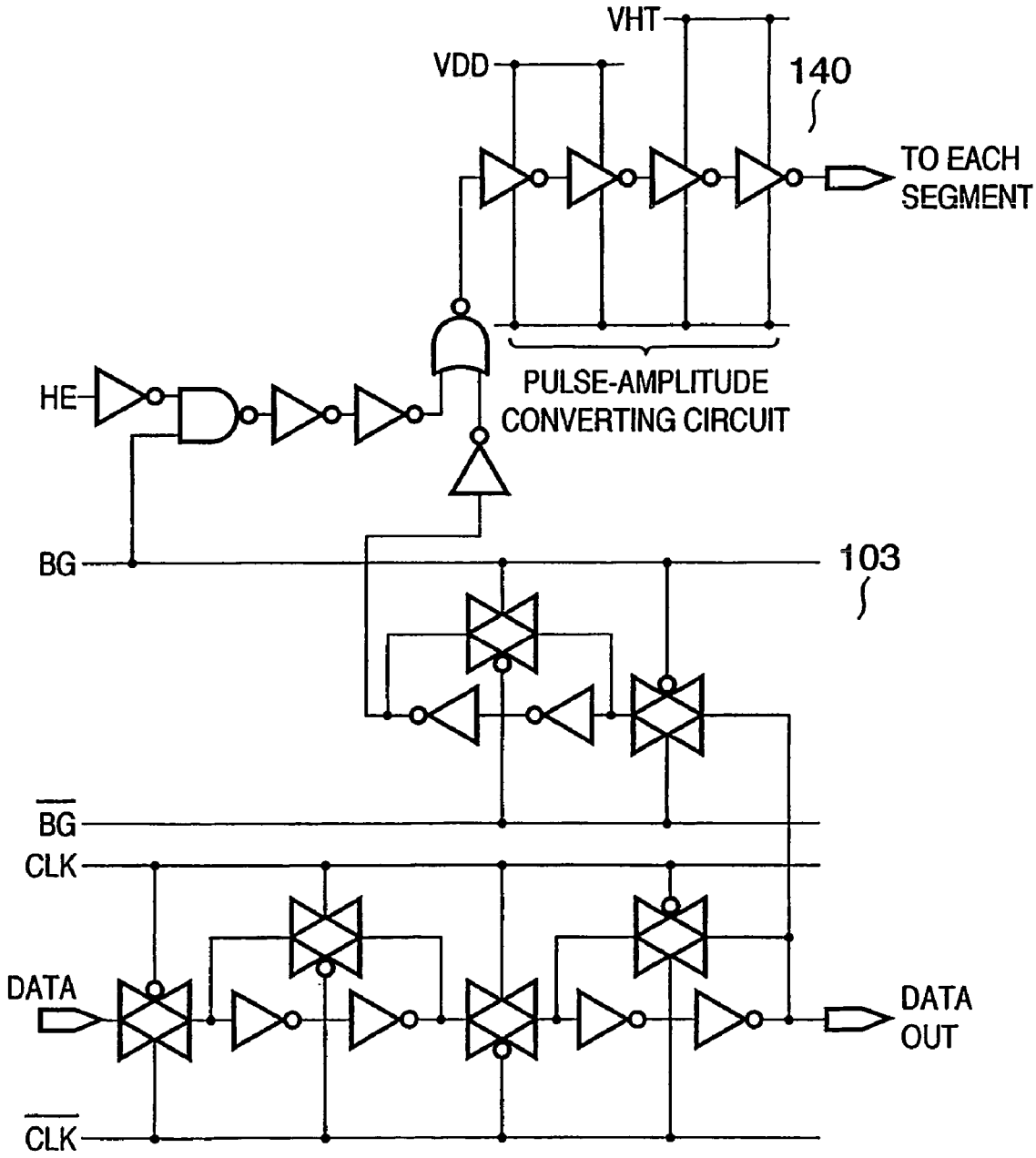
FIG. 3 is a diagram illustrating the structure of a shift register 103 according to this embodiment.

FIG. 2 is one segment's worth of an equivalent circuit diagram for supplying current to and driving a heater for discharging ink in the first embodiment. Further, FIG. 3 is an equivalent circuit that corresponds to one bit of a shift register and latch circuit for temporarily storing image data to be printed.

Figure 5:
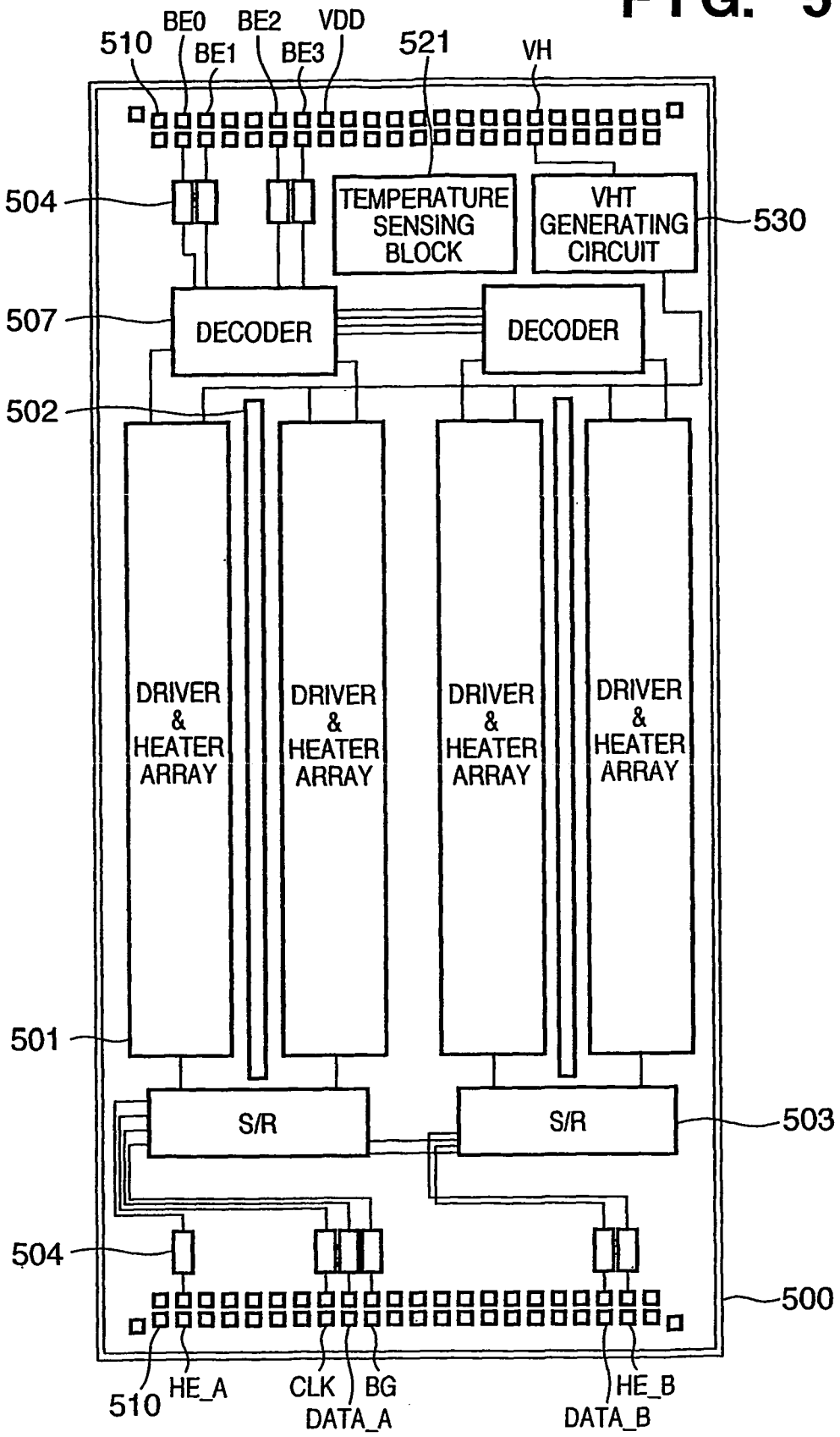
FIG. 5 is a diagram schematically illustrating a semiconductor substrate for an ink-jet printhead, namely a semiconductor substrate for an ink-jet printhead that includes a circuit for outputting a digital signal indicative of sensed temperature.
Figure 6A:
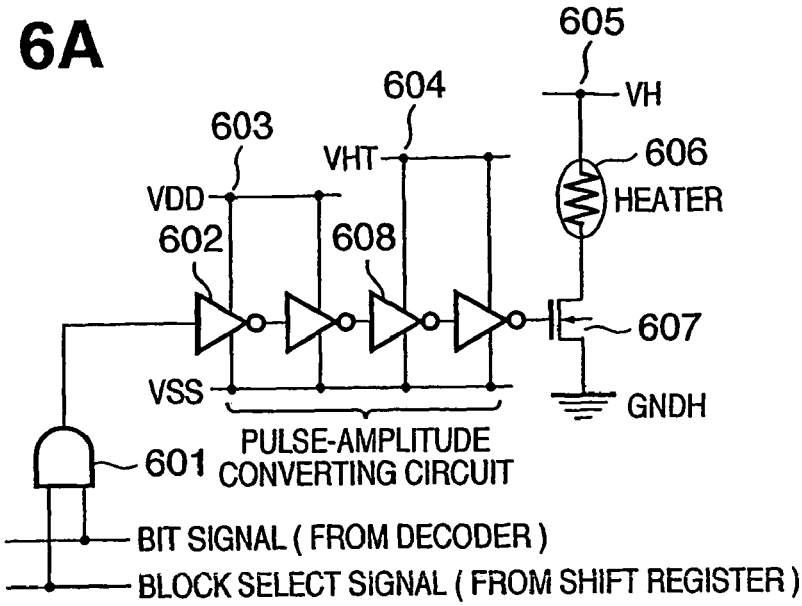
FIG. 6A is one segment's worth of an equivalent circuit diagram for driving current into a heater for discharging ink.

As shown in FIG. 1, the pulse-amplitude converting circuit, which was provided for each segment (each heating resistor for discharging ink) in the conventional circuit described with reference to FIGS. 5 and 6A, is provided in the output section of the shift register 103 and of the decoder 107 on the substrate 100 for the ink-jet printhead of this embodiment. That is, here a structure is adopted in which a pulse-amplitude voltage is raised before the AND is taken between the output signal (block select signal) of the decoder circuit 107 and the output signal (bit signal) of the shift register 103. As a result, as shown in FIG. 2, a pulse whose amplitude has already risen to the VHT voltage is supplied to each segment, and a converting circuit is no longer necessary. Area on the substrate taken up by elements of the circuit therefore is unnecessary.

Since the arrangement is such that a high voltage is applied to the AND gate 201 that takes the AND segment by segment, an element of a high withstand voltage is required for the transistor constructing this circuit. In the prior art, only a low voltage corresponding to the logic voltage is applied to this portion and therefore the transistor is constructed by an element of low withstand voltage. In this embodiment, however, the goal is achieved by giving this portion a withstand voltage higher than that of the transistors constructing the other logic circuits, or more specifically, by adopting an element having a high withstand voltage for the transistor that constructs the AND gate.

In a case where a transistor (MOS transistor) with a high withstand voltage is used, each individual transistor is larger than a low-voltage transistor. However, as mentioned above, the number of pulse-amplitude converting circuits (booster circuits) can be reduced and, with regard to layout location, they can be placed at positions spaced away from the vicinity of each element. As a result, the overall size of the substrate 100 for the ink-jet printhead can be reduced.

Figure 6B:
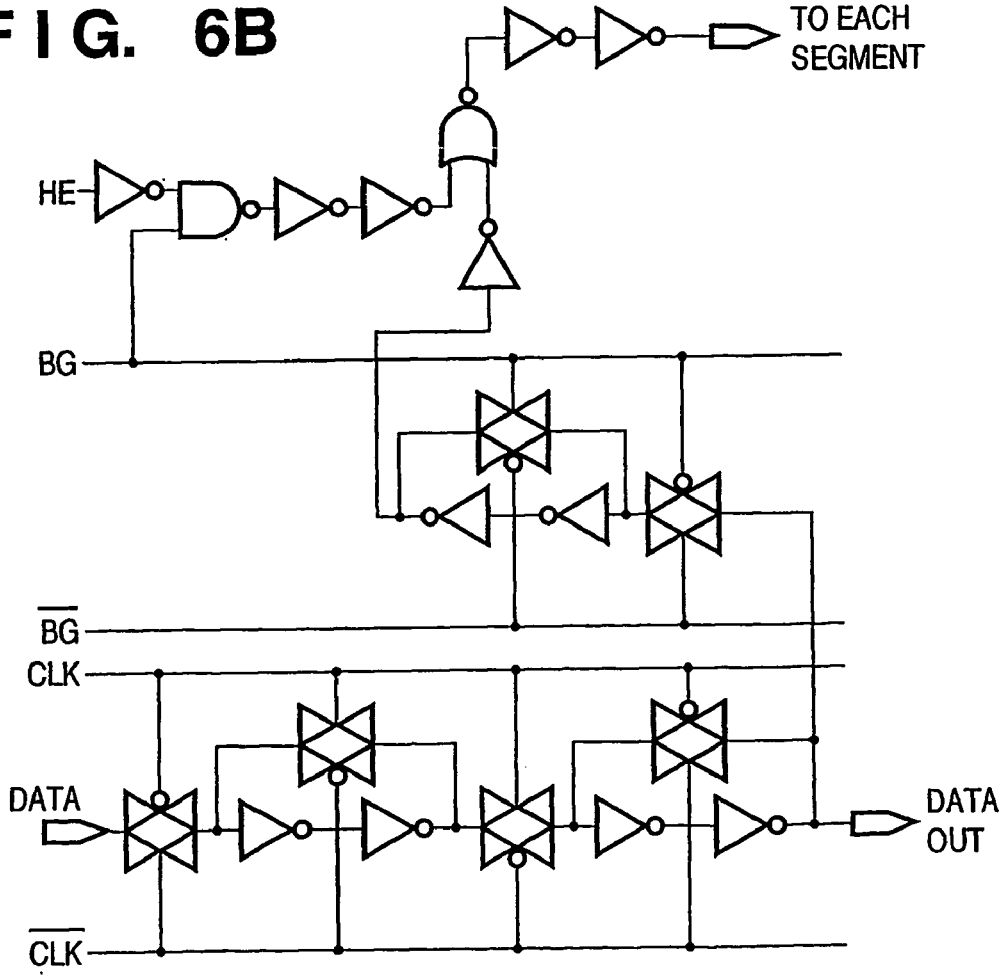
FIG. 6B is an equivalent circuit that corresponds to one bit of a shift register and latch circuit for temporarily storing image data to be printed.
Figure 7:
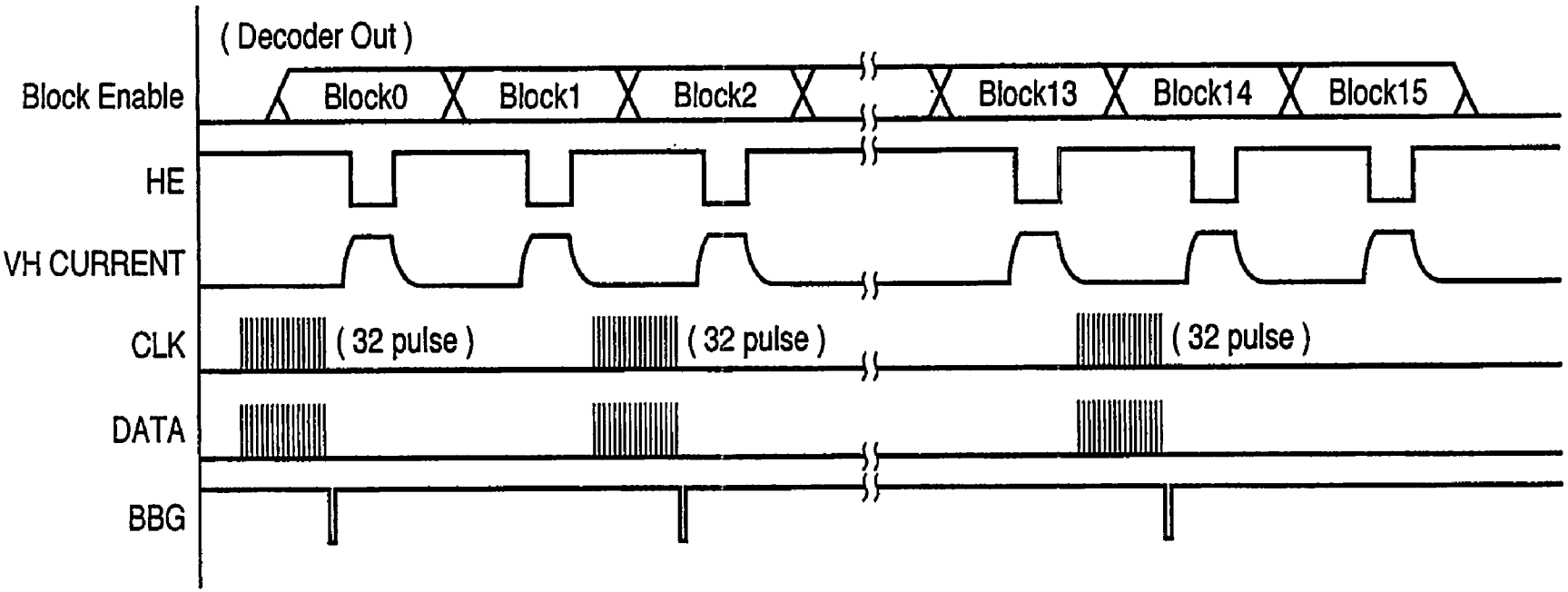
FIG. 7 is a timing chart for describing a series of operations up to sending of print information to the shift register 503 and supplying of current to heaters to drive the same.

FIG. 3 is a diagram illustrating the structure of the shift register 103 and pulse-amplitude converting circuit 140 according to this embodiment. The pulse-amplitude converting circuit is provided in the output stage in the shift-register circuit arrangement illustrated in FIG. 6B. Here the pulse amplitude is converted from the VDD voltage to the VHT voltage.

The number of output stages of the shift register 103 and decoder circuit 107 is decided by the number of divisions when all segments are driven in time-shared fashion, though division is roughly on the order of 8 to 32. For example, if 256 segments are divided by 16 (each block will have 16 segments), the number of pulse-amplitude converting circuits necessary will be 16×2 (shift-register side and decoder side)=32. This is a major reduction in comparison with the 256 circuits needed when all segments are provided with the pulse-amplitude converting circuits. As a result, chip length in the direction perpendicular to the segment array direction can be reduced. Further, though length of the chip in the array direction is increased owing to the pulse-amplitude converting circuit added onto the shift register 103 and decoder circuit 107, this is a very small increase in comparison with the reduction in length in the perpendicular direction and there is a reduction in terms of total chip area.

<Second Embodiment>

Figure 4:
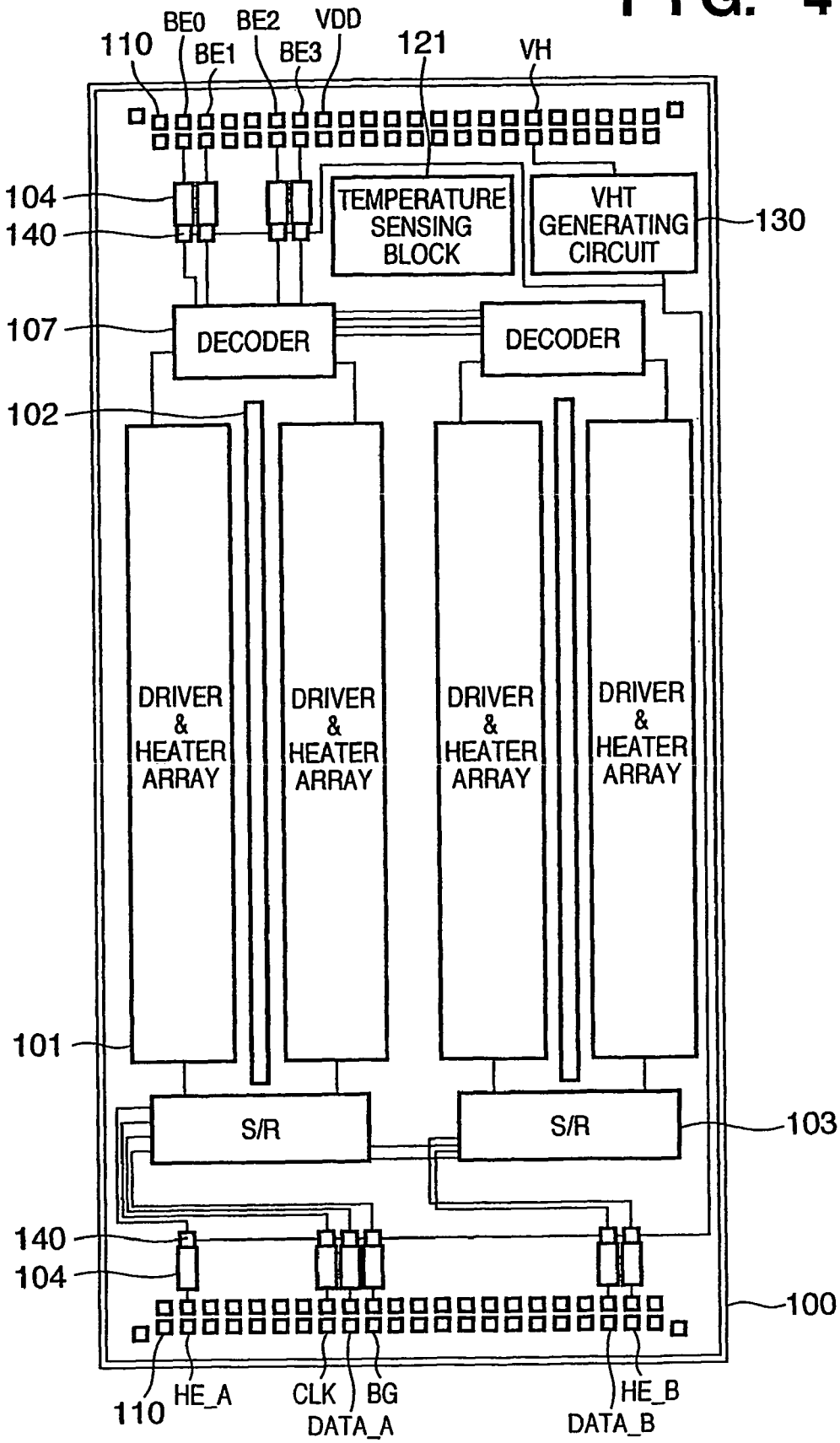
FIG. 4 is a diagram useful in describing a substrate for an ink-jet printhead according to a second embodiment.

FIG. 4 is a diagram useful in describing a substrate for an ink-jet printhead according to a second embodiment. Components in FIG. 4 identical with those in FIG. 1 are designated by like reference numerals and a detailed description thereof is omitted.

In the second embodiment, the configuration adopted is one in which the pulse-amplitude converting circuit 140 is inserted immediately following the input circuit 104. By virtue of this configuration, only pulse-amplitude converting circuits the number of which is equivalent to the number of input terminals (CLK, DATA_A, DATA_B, BG, HE_A, HE_B) are required.

This makes it possible to realize an even greater reduction in chip size.

In accordance with each of the above-described embodiments, as described above, voltage conversion of pulse amplitude that was performed immediately prior to input to the gate terminal of the driver transistor in the prior art is carried out before taking the AND between decoder output and shift-register output. As a result, a circuit structure is implemented in which a segment selection signal that has been input in response to a pulse having the amplitude of VDD voltage is converted to a pulse having the amplitude of VHT voltage without increasing the length of each segment in a direction perpendicular to the array direction of the segments. Also, a circuit structure is implemented in which the number of pulse-amplitude converting circuits is remarkably reduced. Consequently, chip size is reduced, yield is improved by reducing the number of elements and lower cost can be expected owing to simplification of circuit structure.

[Effect of the Present Invention]

In accordance with the present invention, as described above, there can be provided a circuit arrangement in which a voltage for driving logic is converted to a voltage for driving elements without increasing the length of segments in a direction perpendicular to the array direction of the segments. Further, according to the present invention, pulse-amplitude converting circuits are reduced and the number of elements formed on the substrate is reduced, thereby making it possible to raise yield and simplify circuit structure.

As many apparently widely different embodiments of the present invention can be made without departing from the spirit and scope thereof, it is to be understood that the invention is not limited to the specific embodiments thereof except as defined in the appended claims.

The invention claimed is:

1. An ink-jet printhead substrate on which are mounted electrothermal transducers for generating thermal energy utilized to discharge ink and driver circuits for driving said electrothermal transducers comprising:

a logic circuit for outputting, based upon an input signal of a first voltage amplitude level, a block selection signal and an element driving signal, which is for each electrothermal transducer in a selected block, at a second voltage amplitude level which is higher than the first voltage amplitude level; and a driver circuit for driving the electrothermal transducers in block units based upon the block selection signal and element driving signal output from said logic circuit, which have the second voltage amplitude level.

2. The ink-jet printhead substrate according to claim 1, wherein said logic circuit comprises:

a first converting circuit for converting input data of the first voltage amplitude level to the second voltage amplitude level; and a second converting circuit for generating a block selection signal of the second voltage amplitude level and an element driving circuit for a selected block from an input signal of the second voltage amplitude level obtained from said first converting circuit.

3. The ink-jet printhead substrate according to claim 1, further comprising a monitor element for sensing a state of said semiconductor substrate.

4. The ink-jet printhead substrate according to claim 1, wherein said logic circuit includes a shift register circuit, a decoder circuit and a converting circuit for convening signals output from said shift register circuit and said decoder circuit into signals having the second voltage amplitude level.

5. The ink-jet printhead substrate according to claim 4, wherein a withstand voltage of a transistor constituting said driver circuit is higher than that of a transistor constituting said shift register circuit and said decoder circuit in said logic circuits.

6. The ink-jet printhead substrate according to claim 4, further comprising a voltage generating circuit for generating a voltage to be supplied to said conversion circuit based on a voltage supplied to said electrothermal transducers.

7. The ink-jet printhead substrate according to claim 1, wherein said substrate has an ink supply port for supplying ink, and said electrothermal transducers and said driver circuit are arrayed along said ink supply port.

8. The ink-jet printhead substrate according to claim 7, wherein said logic circuit is located in an area other than a portion along said ink supply port.

9. A method of controlling drive of electrothermal transducers on a substrate on which are mounted electrothermal transducers for generating thermal energy utilized to discharge ink and driver circuits for driving said electrothermal transducers comprising:

inputting an input signal of a first voltage amplitude level;

outputting, based upon an input signal of a first voltage amplitude level, a block selection signal and an element driving signal, which is for each electrothermal transducer in a selected block, at a second voltage amplitude level which is higher than the first voltage amplitude level; and driving the electrothermal transducers in block units based upon the block selection signal and element driving signal output from said logic circuit, which have the second voltage amplitude level.

10. An ink-jet printhead comprising:

discharge ports for discharging ink; and a substrate on which are mounted electrothermal transducers provided to correspond to said discharge ports, and driver circuits for driving said electrothermal transducers, wherein said substrate includes:

a logic circuit for outputting, based upon an input signal of a first voltage amplitude level, a block selection signal and an element driving signal, which is for each electrothermal transducer in a selected block, at a second voltage amplitude level which is higher than the first voltage amplitude level; and a driver circuit for driving the electrothermal transducers in block units based upon the block selection signal and element driving signal output from said logic circuit, which have the second voltage amplitude level.

11. The ink-jet printhead according to claim 10, wherein said logic circuit includes a shift register circuit, a decoder circuit and a converting circuit for converting signals output from said shift register circuit and said decoder circuit into signals having the second voltage amplitude level.

12. The ink-jet printhead according to claim 11, wherein a withstand voltage of a transistor constituting said driver circuit is higher than that of a transistor constituting said shift register circuit and said decoder circuit in said logic circuits.

13. The ink-jet printhead according to claim 11, further comprising a voltage generating circuit for generating a voltage to be supplied to said conversion circuit based on a voltage supplied to said electrothermal transducers.

14. The ink-jet printhead according to claim 10, wherein said substrate has an ink supply port for supplying ink to said substrate, and said electrothermal transducers and said driver circuit are arrayed along said ink supply port.

15. The ink-jet printhead according to claim 14, wherein said logic circuit is located in an area other than a portion along said ink supply port.

16. An ink-jet printhead cartridge comprising an ink-jet printhead and an ink tank filled with ink for being supplied to said ink-jet printhead, said ink-jet printhead having discharge ports for discharging ink and a substrate on which are mounted electrothermal transducers provided to correspond to said discharge ports, and driver circuits for driving said electrothermal transducers, wherein said substrate includes:

a logic circuit for outputting, based upon an input signal of a first voltage amplitude level, a block selection signal and an element driving signal, which is for each electrothermal transducer in a selected block, at a second voltage amplitude level which is higher than the first voltage amplitude level; and a driver circuit for driving the electrothermal transducers in block units based upon the block selection signal and element driving signal output from said logic circuit, which have the second voltage amplitude level.

17. An ink-jet printing apparatus comprising an ink-jet printhead and a circuit for transmitting a control signal to said printhead, said ink-jet printhead having discharge ports for discharging ink and a substrate on which are mounted electrothermal transducers provided to correspond to said discharge ports, and driver circuits for driving said electrothermal transducers, wherein said substrate includes:

a logic circuit for outputting, based upon an input signal of a first voltage amplitude level, a block selection signal and an element driving signal, which is for each electrothermal transducer in a selected block, at a second voltage amplitude level which is higher than the first voltage amplitude level; and a driver circuit for driving the electrothermal transducers in block units based upon the block selection signal and element driving signal output from said logic circuit, which have the second voltage amplitude level.

* * * * *

UNITED STATES PATENT AND TRADEMARK OFFICE

CERTIFICATE OF CORRECTION

PATENT NO. : 7,267,429 B2
APPLICATION NO. : 10/555304
DATED : September 11, 2007
INVENTOR(S) : Tatsuo Furukawa It is certified that error appears in the above-identified patent and that said Letters Patent is hereby corrected as shown below:

COLUMN 3

Line 7, “printhead-takes” should read --printhead takes--.

COLUMN 4

Line 59, “and” should be deleted; and
Line 61, “circuit.” should read --circuit;--.

COLUMN 5

Line 14, “made have” should read --may have--.

COLUMN 6

Line 27, “timing” should read --timing,--;
Line 29, “had” should read --made--;
Line 30, “described” should read --describe--; and
Line 44, “motor 1709” should read --motor--.

COLUMN 7

Line 26, “channels” should read --channel--; and
Line 44, “called-a” should read --called a--.

COLUMN 9

Line 39, close up right margin; and
Line 40, close up left margin.

UNITED STATES PATENT AND TRADEMARK OFFICE

CERTIFICATE OF CORRECTION

PATENT NO. : 7,267,429 B2
APPLICATION NO. : 10/555304
DATED : September 11, 2007
INVENTOR(S) : Tatsuo Furukawa It is certified that error appears in the above-identified patent and that said Letters Patent is hereby corrected as shown below:

COLUMN 10

Line 38, "convening" should read --converting--.

Signed and Sealed this

Sixth Day of May, 2008

JON W. DUDAS
*Director of the United States Patent and Trademark Office*